US005395295A

United States Patent [19]

Ish, III

[11] Patent Number: 5,395,295

[45] Date of Patent: Mar. 7, 1995

[54] APPARATUS FOR PERFORMING LEG EXTENSIONS AND CURL EXERCISES

[75] Inventor: Arthur B. Ish, III, Renton, Wash.

[73] Assignee: Vectra Fitness, Inc., Redmond, Wash.

[21] Appl. No.: 107,344

[22] Filed: Aug. 16, 1993

Related U.S. Application Data

[63] Continuation of Ser. No. 838,478, Feb. 19, 1992, abandoned.

[51] Int. Cl.[6] ..... A63B 23/04

[52] U.S. Cl. ..... 482/100; 482/133

[58] Field of Search ..... 482/94, 97, 98, 99, 482/100, 101, 133, 134, 137, 138, 139

[56] References Cited

U.S. PATENT DOCUMENTS

| | | | |
|---|---|---|---|
| 3,000,632 | 9/1961 | Fuchs | 482/97 |
| 3,120,954 | 2/1964 | Apostol | 482/137 X |
| 4,266,766 | 5/1981 | Calderone | 482/97 |
| 4,509,746 | 4/1985 | Mask | 482/137 |
| 4,575,077 | 3/1986 | Osborne et al. | 482/137 |
| 4,634,127 | 1/1987 | Rockwell | 482/138 |
| 4,678,185 | 7/1987 | Mahnke | 482/137 |
| 4,746,114 | 5/1988 | Grider | 482/100 x |
| 4,809,972 | 3/1989 | Rasmussen et al. | 482/138 X |
| 4,844,456 | 7/1989 | Habing et al. | 482/100 |
| 4,883,269 | 11/1989 | Shaver | 482/97 |
| 4,986,538 | 1/1991 | Ish, III | 482/100 X |
| 5,108,095 | 4/1992 | Nichols | 482/137 |

*Primary Examiner*—Richard J. Apley
*Assistant Examiner*—John Mulcahy
*Attorney, Agent, or Firm*—Seed and Berry

[57] ABSTRACT

An exercise machine for performing leg extension and leg curl exercises has a seat from the front of which a swing member depends. A swing link is pivotally connected near the lower end of the swing member and supports a pair of laterally extending pads. A rearwardly directed force is applied to the swing member to act in opposition to forward movement of the swing member and swing link when an exerciser pushes against one of the pads with one of his (her) legs when the exerciser is seated (leg extension exercise) or is standing facing rearwardly with the seat swung upwardly to an upright position.

3 Claims, 2 Drawing Sheets

APPARATUS FOR PERFORMING LEG EXTENSIONS AND CURL EXERCISES

CROSS-REFERENCE TO RELATED APPLICATION

This application is a continuation of U.S. patent application Ser. No. 07/838,478, filed Feb. 19, 1992, now abandoned.

TECHNICAL FIELD

The present invention relates to exercise machines particularly designed for performing leg extension and leg curl exercises.

BACKGROUND OF THE INVENTION

FIGS. 4 and 6 of U.S. Pat. No. 4,809,972 illustrate an example of a leg extension/curl exercise station having a tilt-up seat with a fixed semi-reclined back rest. A front swing member depends from a pivot connection with the support for the seat and has a padded pair of laterally extending leg engagement arms adjacent its lower end. A loaded cable resists forward swinging movement of the swing member.

When performing the leg extension exercise the exerciser is seated and has his(her) legs positioned behind the leg engagement arms. Both legs are then swung forwardly at the knees while in engagement with the back of the leg engagement arms so that the swing member is swung upwardly under the load exerted by the loaded cable. During this swinging motion the cable is guided around an arched cable guide member at the back of the swing member.

When performing the leg curl exercise the exerciser faces rearwardly and grasps the handles on the sides of the seat with the seat locked in a tilted upright position. The exerciser than swings his legs rearwardly at the knee, one at a time., from floor contact so that the back of the swung leg engages the back of the respective leg engagement arm. Further leg swing causes the swing member to swing forwardly of the seat in opposition to the loaded cable.

The described mechanism does not have provision for various leg lengths and hence the leg engagement arms slide part way along the legs of some exercisers while they are performing the leg extension and/or leg curl exercisers. This problem can be partly solved by slide mounting the leg engagement arms on the swing member for pin connection to any of a series of holes in the swing member. However, if the exercise machine is used by several people it is annoying to make multiple adjustments of the leg engagement arms.

SUMMARY OF THE INVENTION

The present invention aims to provide a relatively simple solution to the adjustment problem without requiring slide adjustments to be made.

In accordance with the present invention the pair of leg engagement arms is not mounted directly on the swing member. Instead, these arms are mounted on a swing link unit which is swing mounted adjacent the lower end of the swing member such that the arms can be swung up and down by the swing link unit forwardly of the swing member. Stops restrict the swing range of the swing link unit relative to the swing member. By this improved arrangement the lineal distance between the top of the swing member and the leg engagement arms will automatically vary and adjust to leg length without requiring manipulation of an adjustment mechanism preliminary to exercising.

DETAILED DESCRIPTION OF THE INVENTION

Figure 1:
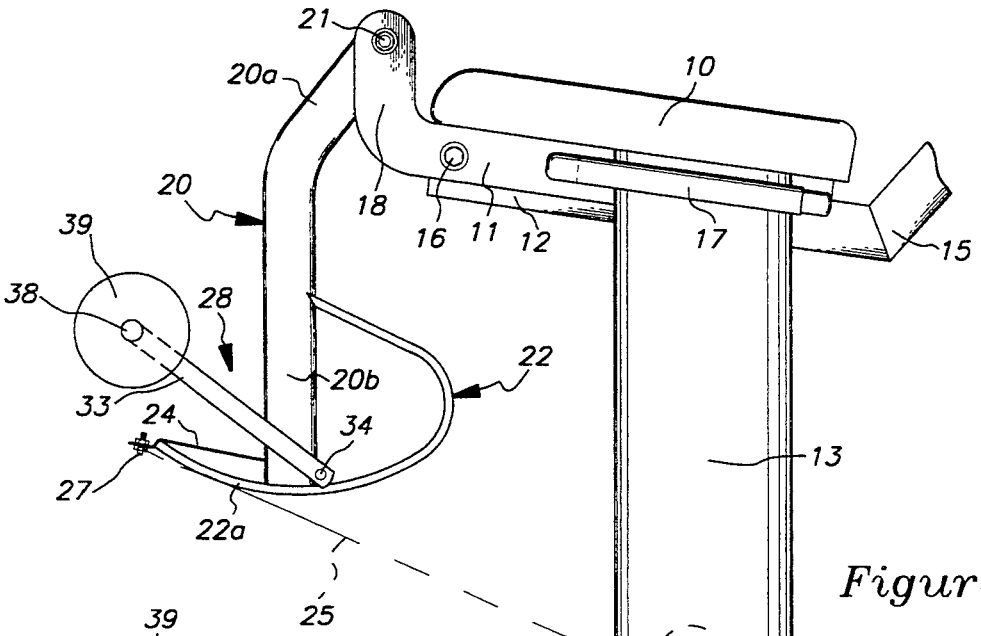
FIG. 1 is a side elevational view of an exercise station with apparatus embodying the present invention.
Figure 2:
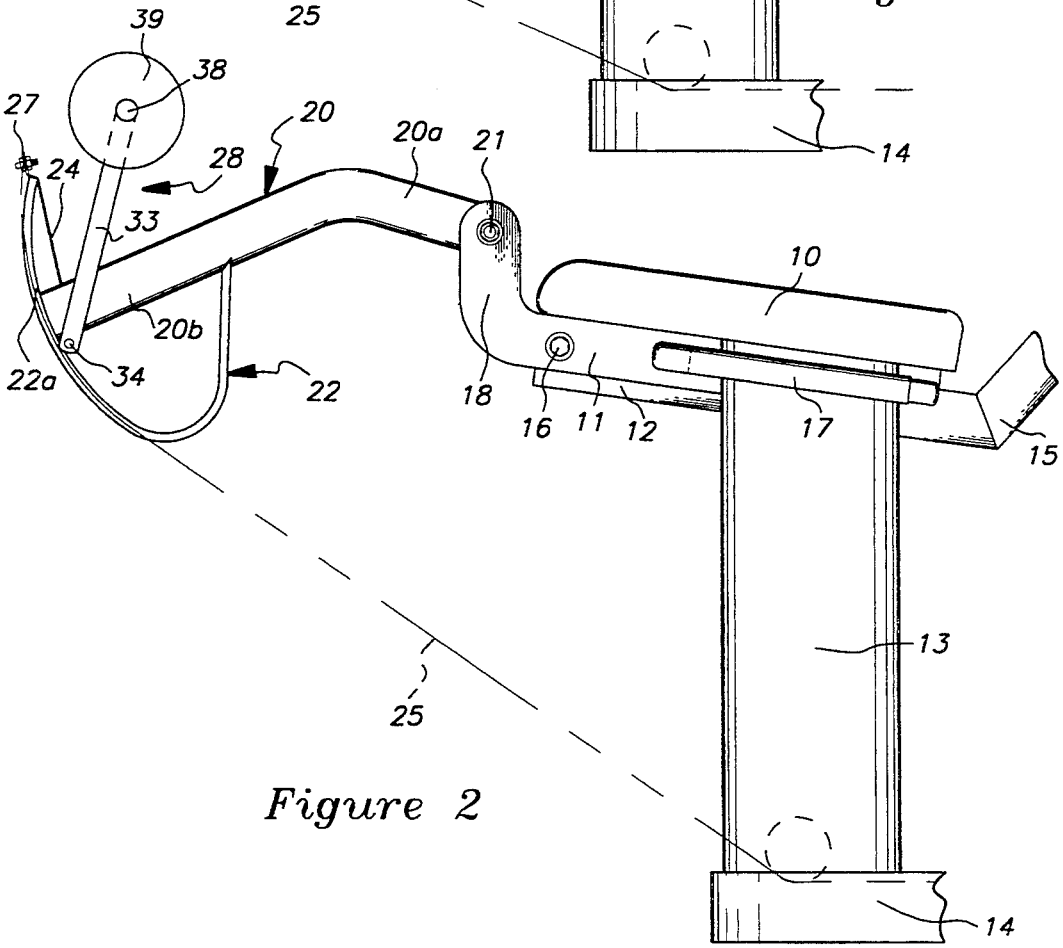
FIG. 2 is a side elevational view showing a leg extension exercise position of the apparatus.
Figure 3:
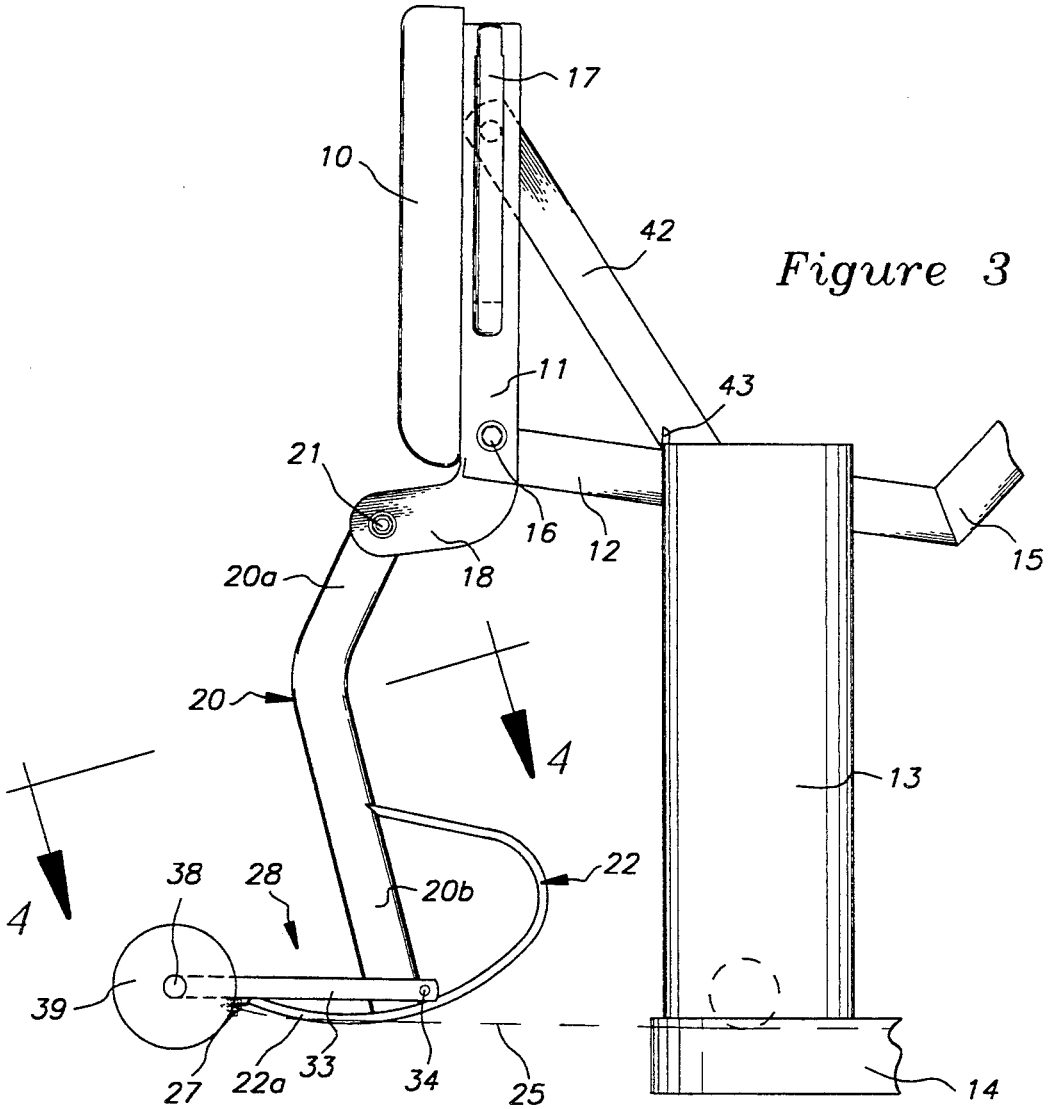
FIG. 3 is a side elevational view showing a leg curl exercise position of the apparatus.

Referring to the drawings a seat 10 has a pair of laterally spaced base members 11 which straddle a forward portion of a central seat support member 12 mounted on a pedestal 13 upstanding from a base frame 14. The seat support member 12 passes through the upper end of the pedestal 14 and has a rear upwardly sloping extension 15 to support a reclining back (not shown) for the seat 10. The base members 11 of the seat are pivotally mounted at 16 to swing upwardly at the front as shown in FIG. 3 and are connected to a pair of side handles 17. The base members 11 bend upwardly at the front of the seat to provide a pair of forks 18 for receiving the upper end of a depending swing member 20 pivotally mounted by a pin 21. This pin 21 is raised above the seat level to be located approximately in alignment with the knee pivots of an exerciser seated on the seat 10. The swing member 20 is preferably bent to provide a sloping upper section **20*a* and a lower section 20*b*** forming an obtuse angle therebetween of about 135 degrees.

Welded to the bottom and back of the lower section **20*b* of the swing member 20 is a rearwardly arched cable guide 22 with an external V-groove therealong. This cable guide has a front, foot portion 22*a* projecting forwardly beyond the lower end of the swing member 20 and connected to a toe strap 24 which has its rear end secured to the lower section 20*b*. A loading cable 25 is connected at its forward end to the front of the toe strap as indicated at 27. The cable 25 extends rearwardly from the guide 22 and is guided by pulleys to lift a weight stack (not shown), for example, responsive to forward swinging movement of the swing member 20**.

Figure 4:
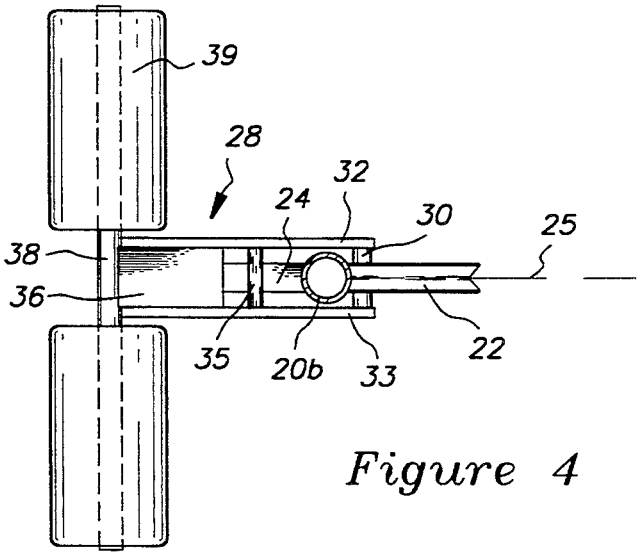
FIG. 4 is a sectional view taken as indicated by line 4—4 in FIG. 3.

Referring to FIG. 4, by way of the present invention a link unit 28 is pivotally mounted at a tube 30 which is welded in position at the heel of the swing member 20. The link unit 28 comprises a pair of side links 32, 33 joined at the rear by a pin 34 extending through the tube 30. Forwardly of the swing member 20 the side links 32 are connected together by a central stop pin 35, a web 36, and a front tube 38 projecting laterally to both sides as arms for receiving cylindrical pads 39. The stop pin 35 is preferably covered with a resilient sleeve to dampen impact between the stop pin and the front of the swing member 20 or the top of the toe strap 24.

When the leg extension exercise is being performed the exerciser is seated on the seat 10 and has his(her) legs positioned behind the pads 39. The legs are raised below the knees to bring the front of the ankles into engagement with the back of the pads 39 whereupon the extension exercise is performed by further raising of the legs in opposition to the loaded cable 25. During this movement the lineal distance between the pads 39 and the pivot 18 is free to adjust by swinging of the link unit 28 relative to the swing member 20. This adjustment, while the exercise is being performed, accommodates for any misalignment existing between the pivot 21 of the swing member 20 and the knee pivots of the exerciser.

When the leg curl exercise is to be performed the seat 10 is locked in a vertical tilted up position, shown in FIG. 3, by a swing link 42 on the underside of the seat having a slot 43 arranged to interfit with the rim of the pedestal 13. The exerciser faces rearwardly toward the seat and normally grips the side handles 17. Then the exerciser raises one leg at the knee and brings the back of the respective ankle into engagement with the adjacent pads 39. The leg extension exercise is performed by swinging the leg back and forth rearwardly at the knee in opposition to the loaded cable 25. The exercise is repeated for the other leg by engaging the other pad 39. As in the case of the leg extension exercise, the lineal distance between the pads 39 and the pivot 18 is free to adjust to the proper distance for the exerciser's leg length by swinging of the link unit 28 relative to the swing member 20.

I claim:

1. An exercise machine for performing a leg extension exercise comprising:

a seat;

a swing member suspended at a first transverse swing axis adjacent the front of said seat for swinging forwardly relative to said seat;

a link unit swing-mounted on said swing member at a second transverse swing axis adjacent the lower end of said swing member for up and down swinging movement relative to said swing member and seat;

a horizontal pair of aligned oppositely extending leg engagement members mounted on said link unit at a position remote from said second axis, said leg engagement members extending laterally with respect to said link unit and swing member free of any adjacent obstruction so that the back side of said leg engagement members can be engaged by the legs of an exerciser seated on said seat for substantially the full lateral reach of said members from said link unit, said swing member having no laterally extending leg engagement members mounted on or carried by said swing member other than said leg engagement members mounted on said link unit;

a bottom forward extension member on said swing member arranged to be engaged by said link unit for limiting downward movement of said link unit and leg engagement members relative to said swing member; and a load means connected to said swing member for resisting forward swinging movement of said swing member when an exerciser seated on said seat pushes said leg engagement members forwardly with his or her legs adjacent the ankles in performing a leg extension exercise.

2. An exercise machine for performing a leg extension exercise comprising:

a seat;

a swing member suspended at a first transverse swing axis adjacent the front of said seat for swinging forwardly relative to said seat;

a link unit swing-mounted on said swing member at a second transverse swing axis adjacent the lower end of said swing member for up and down swinging movement relative to said swing member and seat;

said swing member having a bottom forward extension member, and said link unit including an intermediate stop element arranged to engage said swing member to limit upward movement of said leg engagement members, and arranged to engage said extension member to limit downward movement of said leg engagement members;

a horizontal pair of aligned oppositely extending leg engagement members mounted on said link unit at a position remote from said second axis, said leg engagement members extending laterally with respect to said link unit and swing member free of any adjacent obstruction so that the back side of said leg engagement members can be engaged by the legs of an exerciser seated on said seat for substantially the full lateral reach of said members from said link unit, said swing member having no laterally extending leg engagement members mounted on or carried by said swing member other than said leg engagement members mounted on said link unit; and a load means connected to said swing member for resisting forward swinging movement of said swing member when an exerciser seated on said seat pushes said leg engagement members forwardly with his or her legs adjacent the ankles in performing a leg extension exercise.

3. An exercise machine according to claim 2 in which said forward extension member has a cable attached thereto which is connected to a load for resisting forward swinging movement of said swing member.

* * * * *